US008162779B1

(12) United States Patent
Sweeney

(10) Patent No.: US 8,162,779 B1
(45) Date of Patent: Apr. 24, 2012

(54) PUTTING GUIDE METHOD AND APPARATUS

(76) Inventor: Mark Sweeney, Celebration, FL (US)

( * ) Notice: Subject to any disclaimer, the term of this patent is extended or adjusted under 35 U.S.C. 154(b) by 0 days.

(21) Appl. No.: 13/195,165

(22) Filed: Aug. 1, 2011

Related U.S. Application Data

(62) Division of application No. 12/394,154, filed on Feb. 27, 2009, now Pat. No. 7,988,572.

(60) Provisional application No. 61/031,860, filed on Feb. 27, 2008.

(51) Int. Cl.
*A63B 69/36* (2006.01)
*A63B 57/00* (2006.01)

(52) U.S. Cl. ..... 473/409; 473/404; 473/407

(58) Field of Classification Search ..... 473/150, 473/156–158, 173, 174, 257, 278, 404–407, 473/409; 33/377, 376, 381, 389, 390
See application file for complete search history.

(56) References Cited

U.S. PATENT DOCUMENTS 4,082,286 A 4/1978 La Breche
4,260,151 A 4/1981 Weaver
5,209,470 A 5/1993 Cimaroli et al.
5,330,179 A 7/1994 Hampel
5,476,258 A 12/1995 Frisone
5,755,623 A 5/1998 Mizenko
6,027,417 A 2/2000 Zoretic et al.
6,095,933 A 8/2000 Smith
6,165,083 A 12/2000 Stenger et al.
6,296,579 B1 10/2001 Robinson
6,386,994 B1 5/2002 H'Doubler et al.
6,592,473 B2 7/2003 McDonald et al.
6,638,173 B2 10/2003 Robinson
7,988,572 B1 * 8/2011 Sweeney ..... 473/407

* cited by examiner

*Primary Examiner* — Nini Legesse
(74) *Attorney, Agent, or Firm* — Christine Q. McLeod; Beusse Wolter Sanks Mora & Maire, PA

(57) ABSTRACT

An improved system, method, and apparatus, computer-readable medium for a putting reference guide is provided that includes a plurality of reference indicia graphically representing a hole and a green surrounding the hole, wherein the hole is a center point in a center of a series of circumferential rings around the hole, wherein each ring represents a distance out from the hole, and a series of spokes radiating from the center point, wherein each spoke represents a putt's angle with respect to a reference point, wherein within each ring and between each spoke the expected break is provided.

11 Claims, 3 Drawing Sheets

PUTTING GUIDE METHOD AND APPARATUS

CROSS-REFERENCE TO RELATED APPLICATIONS

This is a division of application Ser. No. 12/394,154 filed Feb. 27, 2009, granted under U.S. Pat. No. 7,988,572, and claims priority from U.S. provisional application Ser. No. 61/031,860, filed Feb. 27, 2008, the disclosures of which are incorporated herein by reference in their entireties.

BACKGROUND OF THE INVENTION

1. Field of the Invention

The present invention relates generally to golfing, and more particularly to methods and devices for improving putting.

2. Discussion of the Background

One of the biggest challenges in the game of golf is putting, not because the putting stroke is particularly difficult to master, but because golf greens all have unique surface shapes which cause the ball to turn, or break, in seemingly unpredictable amounts and directions as it rolls towards the hole. Additionally, the amount of break a putt experiences is conditional on green speed (a measure of frictional resistance of a ball rolling on a green, commonly measured by the Stimpmeter and called the "stimp") which is not consistent for all courses, or even on the same course within the time period that the round is played. Green speeds can change during the day as the grass dries out and begins to grow after the morning mowing. For example, a putt that breaks 6 inches on a green measuring 8 on the stimpmeter, may break 14 inches—more than twice as much—when the green speed measures at 12. The faster the green speed, the more a particular putt will break.

Arising from this challenge is the discipline of green reading—the ability to determine how much a putt will break and therefore where the golfer must aim it so that the golf ball falls in the hole. Due to the relative subtly of the slope found around a typical hole on a golf green (1%-3% grade), human visual processes are not well equipped at determining both direction and amount of such slopes, and therefore of the break of the putt. There are also many visual illusions which can give the golfer unreliable interpretations of the uphill vs. downhill directions.

Golf green reading devices address this issue but are primarily designed to mechanically show a golfer the direction and degree of slope of a golf green, and do not translate that information into how much break the putt will experience. U.S. Pat. No. 4,260,151 uses a plumb bob device to indicate the slope of the green, and U.S. Pat. Nos. 6,386,994, 6,095,933, 5,755,623, 5,476,258, and 5,209,470 utilize bubble levels to indicate the direction and/or amount of slope, but again do not provide the golfer with what he really needs, which is the amount of break to play for any given putt. U.S. Pat. Nos. 4,082,286 and 5,330,179 also use a spirit level to gauge the amount of slope and then translate that into an offset distance which would estimate the amount of break of the putt. Stenger (U.S. Pat. No. 6,165,083) discloses an electrical level detector that will compute an offset distance after taking at least two measurements on the green. However, the USGA Rules of Golf section 14-3 forbid the use of any and all of these artificial measuring devices during play (plumb bobs and levels), so they can only be used during practice sessions and are of limited use to the golfer.

Golfers putting on golf greens are faced with the challenge of determining the curvature of the path of a putted golf ball before they strike it, but currently have no reliable method, approved by the USGA Rules of Golf, of predicting the amount of break the ball will experience.

All patents, patent applications, provisional applications, and publications referred to or cited herein, or from which a claim for benefit of priority has been made, are incorporated herein by reference in their entirety to the extent they are not inconsistent with the explicit teachings of this specification.

SUMMARY OF THE INVENTION

The present invention does not attempt to artificially measure the slope of the green, but rather relies on common principles of golf green architecture to simulate how putts would behave on typical putting surfaces and then present that aim information to the golfer as a static reference guide, such as a printed chart (e.g., a booklet of charts) or a graphically displayed series of charts on a computer display device.

The present invention uses golf physics and knowledge golf green architecture to provide the golfer with a guide showing the required starting velocity or the specific amount of break any putt is expected to have depending on its distance, angle to the hole, and the current green speed. The invention models the behavior of any putt on a given radius around the hole, determines the optimum starting velocity, travel time, and the amount of break a putt is expected to have, and provides the golfer with an easy and quick reference guide to use during play.

The invention can be implemented in numerous ways, including as a system, a device/apparatus, a method, product by process, or a computer readable medium. Several embodiments of the invention are discussed below.

As a device, the invention comprises a putting reference guide for each hole comprising a plurality of reference indicia graphically representing a hole and the green surrounding the hole, wherein the hole is a center point in the center of a series of circumferential rings around the hole, wherein each ring represents a distance out from the hole (such as 5', 10', 15', and 20'), and a series of spokes/lines radiating from the center wherein each spoke represents the putt's angle with respect to a reference point (such as the straight downhill direction of the slope), wherein the spokes can be labeled in degree measurements from the reference point (0-360 degrees, with 0 representing the straight downhill direction of the slope) or as hour hand positions on a clock face from the reference point (with 12:00 representing the straight downhill direction of the slope), wherein within each ring and between each spoke the expected break is provided.

In an alternate embodiment, the putting reference guide may comprise a semi-circle, since on a planar surface, the breaks at the hour hand positions on one side of the clock mirror the other side, so that the expected break amounts would be the same. The user would only need to refer to one side, knowing the other side is a mirror image thereof. In that manner, in another embodiment, the other side may represent a semi-circular guide for a different slope or for a different green speed. An indication of the slope or green speed for the displayed semi-circle would be shown on the semi-circle for user reference.

As a method, the invention comprises improving golf play comprising, for each selected golf hole of a golf course played, the steps of: (a) selecting a corresponding putting reference guide from a plurality of putting reference guides for the hole, each guide correlated to a golf hole of a golf course and including, for said golf hole; (b) estimating the putt's angle of a desired golf stroke with respect to a reference point, such as a straight downhill direction of the slope, and locating this angle on the guide, represented as a series of spokes/lines radiating from the center/hole, said spokes represented for ease of reference as a degree measurement (0-360 degrees) or as an hour hand position on a clock face (12 hourly positions); (c) estimating the distance of the desired golf stroke and locating this distance (or distance range) on the guide, represented as a series of circumferential rings around the hole, wherein each ring represents a distance out from the hole (such as 5', 10', 15', and 20'); wherein the guide provides for the located ring and spoke location a calculated approximation of an expected break amount. For intermediate angles, such as 1:30, an average of the 1:00 and 2:00 expected break amounts can be used. For intermediate distances, such as 12 feet, an average of the 10 foot and 15 foot expected break amounts can be used.

As a computer implemented method (i.e., using a computing device having one or more processors, input device, output device, and storage device), the invention comprises (a) receiving a selection of a corresponding putting reference guide from a plurality of putting reference guides for the hole, each guide correlated to a golf hole of a golf course; (b) receiving from a user an estimated putt's angle of a desired golf stroke with respect to a reference point, such as a straight downhill direction of the slope, and correlating by a processor this angle on the guide, represented as a series of spokes/lines radiating from the center/hole, said spokes represented for ease of reference as a degree measurement (0-360 degrees) or as an hour hand position on a clock face (12 hourly positions); (c) receiving from the user an estimated distance of the desired golf stroke and correlating by the processor this distance (or distance range) on the guide, represented as a series of circumferential rings around the hole, wherein each ring represents a distance out from the hole (such as 5', 10', 15', and 20'); (d) outputting to the user for the correlated ring and spoke location an expected break amount.

As a product-by-process, the invention comprises calculating expected break amounts for a plurality of points on a green around a hole and creating a putting reference guide for each hole comprising a plurality of reference indicia graphically representing a hole and the green surrounding the hole, wherein the hole is a center point in the center of a series of circumferential rings around the hole, wherein each ring represents a distance out from the hole (such as 5', 10', 15', and 20'), and a series of spokes/lines radiating from the center wherein each spoke represents the putt's angle with respect to a reference point (such as the straight downhill direction of the slope), wherein the spokes can be labeled in degree measurements from the reference point (0-360 degrees, with 0 representing the straight downhill direction of the slope) or as hour hand positions on a clock face from the reference point (with 12:00 representing the straight downhill direction of the slope), wherein within each ring and between each spoke the expected break is provided.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 2:
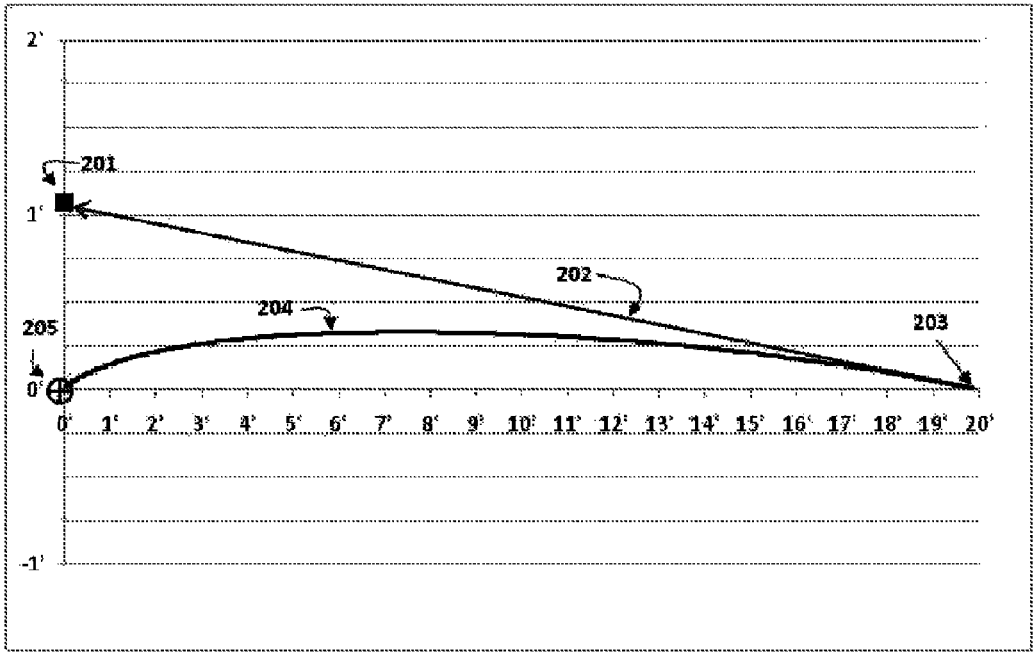
FIG. 2 shows the geometric location of an aimpoint for a given putt.
Figure 3:
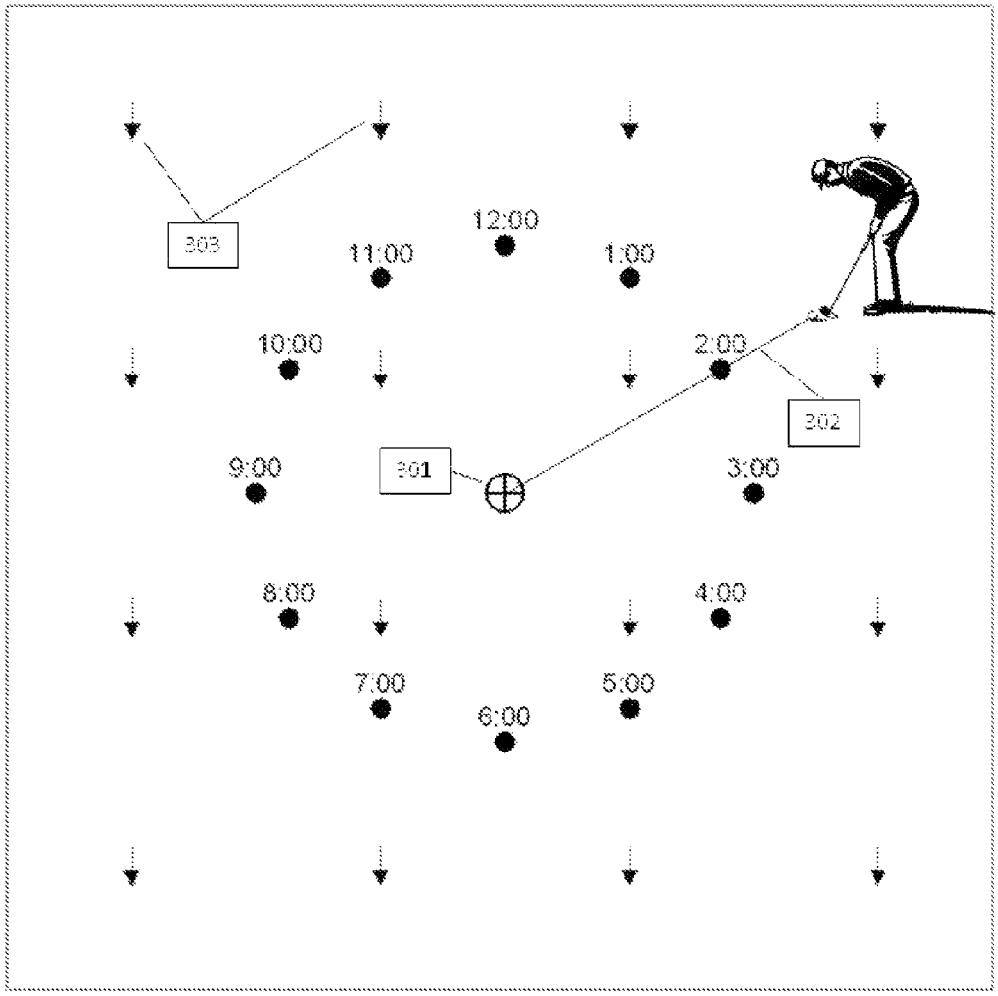
FIG. 3 shows how a golfer estimates his putt's angle relative to the slope of the green.

Broadly speaking, the invention is a chart or guide which the golfer can legally reference (according to the USGA Rules of Golf) during actual play and which shows the optimum starting velocity and/or expected amount of break for a successful putt, dependent upon green speed, distance to the hole, and angle relative to the straight downhill direction of a planar shaped green around the hole position. The figures displayed by the invention can be in any unit of measure (i.e., feet, inches, meters, cups, etc.) and represent how hard the golfer must hit his putt or where the golfer should aim his putt (204) in order for it to fall in the hole, hereinafter called the aimpoint or offset distance. The aimpoint (201) is a spot left or right of the hole (205) that is perpendicular to a straight line (202) drawn between the putt's starting position (203) and the hole (205) (FIG. 2.).

Golf green design must fulfill a number of functions, including to provide fair hole locations and proper drainage of water off the green. In order to ensure that water drains properly and does not puddle, which is harmful to the ergonomic health of the turfgrass, greens are typically designed with a minimum grade of 1% to 1.5%. Grade is defined as the rise over the run of the landscape; so a 100 foot long green with a one foot elevation change is considered to have a 1% grade. Golf greens can and usually do have greater than 1.5% grade in certain areas; however, fair hole locations cannot be on too severe of a grade or else the ball will not stop rolling or will turn dramatically as it slows done, making play exceedingly difficult. A commonly considered fair hole location is one that is between 1% and 3% grade. Given this assumption, it is possible to accurately model the behavior of a putted golf ball for the most common putting distances, namely between 0 and 25 feet from the hole.

Golf statistics show that roughly 85% of all putts are within 25 feet of the hole, with 75% being from 15 feet or less. It also happens to be the case that the slope of the green within 15 feet of the hole tends to be fairly uniform and does not have any radical slope changes, either in direction or magnitude. This design consideration is to provide fairness and playability of the putting surface. A golf ball putted within a given radius of the hole will experience a varying amount of break dependent on its distance to the hole and its angle to the slope of the green. In other words, when putting directly uphill or downhill to the hole, the ball will not break; when putting across the slope, the putt will break more or less depending on its angle.

This invention models the behavior of any putt on a given radius around the hole and determines the optimum starting velocity, travel time, and the amount of break a putt is expected to have, thus providing the golfer with an easy and quick reference guide to use during play. The preferred computer modeling process is based on AimPoint Technologies' proprietary putt prediction software (disclosed in U.S. application Ser. No. 11/000,452 which is incorporated herein by reference) and calculates the starting velocity and aimpoint (201), or break amount, for any or every putt within a given radius of the hole, assuming a planar or geometric putting surface with a specific green speed and grade (typically between 1% and 3%). The results are then tabulated into a static reference guide which the golfer can use as a reliable estimate for predicting putt behavior. Other methods of calculating amount of break can be derived from U.S. Pat. Nos. 4,082,286, 5,330,179 and 6,165,083, (incorporated herein by reference), for example, the results of which are then tabulated into a static reference guide in accordance with the present invention.

The golfer uses the reference guide by first determining the green speed (typically 8 for recreational golf and 10 for tournament golf); the putt's angle (302) to the straight downhill direction of the slope (303), either as a degree measurement or as an hour hand position on a clock face; the distance to the hole (102); and finally by reading the figure in the guide which intersects these estimates (104). For example, if the putt is 10 feet from the hole and originates from the 4 o'clock position relative to the slope, then the total expected break amount would be 6 inches from the center of the hole (or 4 inches from the right edge of the hole). If the green speed were 10, then the total expected break would be 9 inches. If the expected break amount is shown on the right side of the chart, the golfer would aim right in that amount, if on the left side the golfer would aim left in that amount.

The golfer can estimate the putt's angle to the slope by first determining where the straight uphill or downhill putts are (103), using any combination of visual or sensory methods, then determining the ball's angle relative to that line (302). Also, on a planar surface the breaks at the hour hand positions on one side of the clock mirror the other side; so the expected break for 1:00 is the same as 11:00, and the expected break for 5:00 is the same as 7:00. This way only half of the guide is needed per green speed as a reference, and the other half can be used for a different green speed or amount of slope (106).

Figure 1:
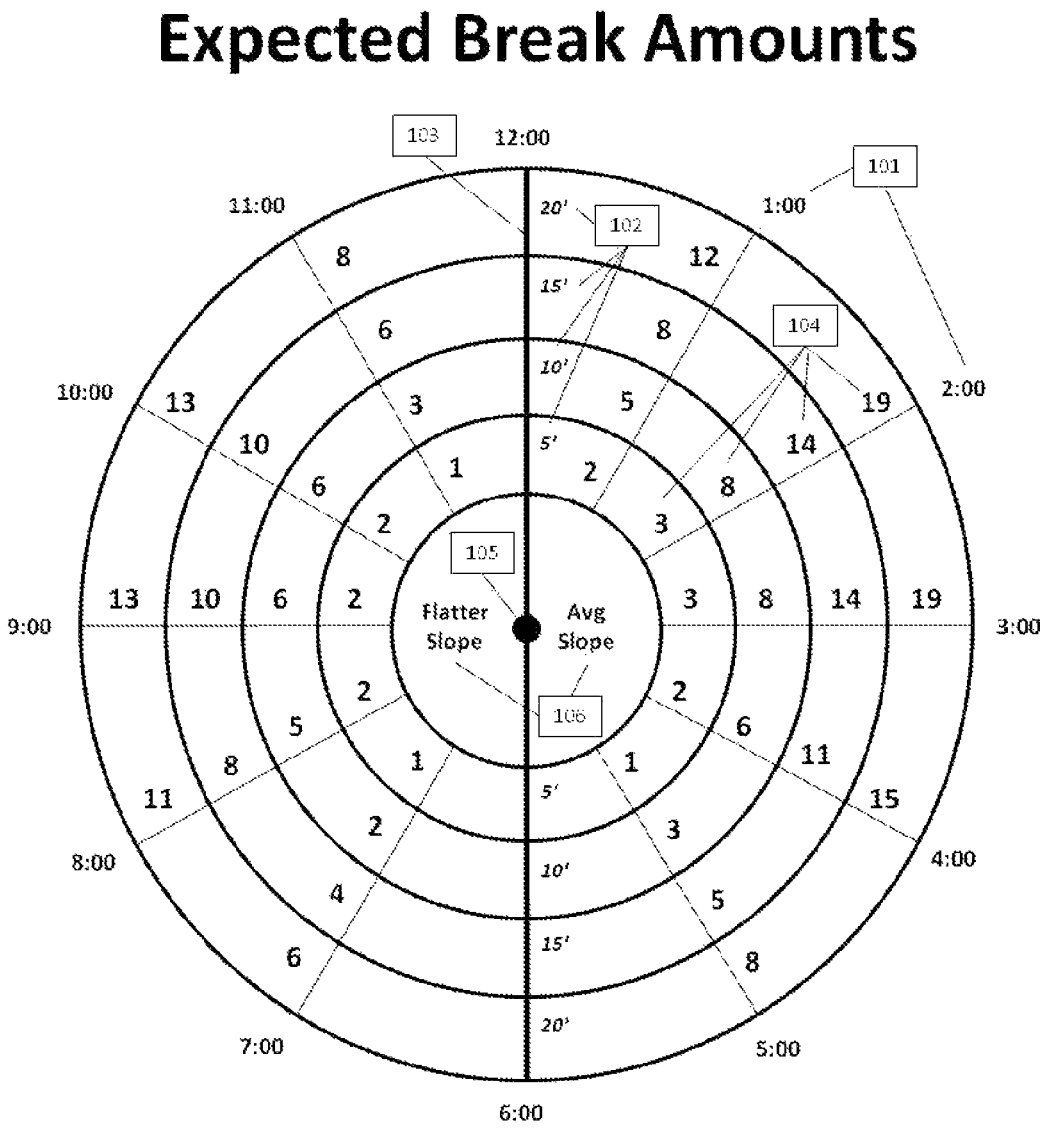
FIG. 1 is a chart showing expected break amounts for putts or varying lengths and angles relative to the downhill direction of a planar shaped green around the hole location.

Specifically, an embodiment of the invention can be a printed chart (FIG. 1) which the golfer carries on the golf course and references when he or she is preparing to putt. Such a chart is considered allowable under the official USGA Rule of Golf because it is not considered an "artificial device or unusual equipment". The chart has concentric circles (102) representing putts of different lengths and angles vectoring from the center of the hole (105) out in different angles, commonly thought of as the hour-hand positions of a clock (101). Once the golfer determines the angle of his or her putt (101), they simply locate the FIG. 104) in the concentric circle which represents the putt's length (102), and then play that amount of break.

If the ball's position is at an intermediate angle, such as 1:30, the golfer simply uses an average of the 1:00 and 2:00 expected break figures. Similarly, if the putt's length is at an intermediate distance, such as 12 feet, the golfer uses and average of the 10 foot and 15 foot expected break amounts.

Greater or fewer putt angle representations may be provided as a matter of design choice. For example, rather than 12 hourly positions, 24 half-hourly positions can be provided. Similarly, greater or fewer distance rings may be provided as a matter of design choice. For example, rather than every 5', the chart could be represented with rings every 4'.

Additionally, the golfer could make minor adjustments to the expected break amounts if the green slopes more or less than typical, though such adjustments would typically be of only a few inches.

The chart can also display different break amounts on the two halves of the chart depending on the severity of the slope. So the golfer could see expected breaks for flat, average, or severe slopes simultaneously (106).

Another embodiment of the invention is a tabular reference guide (not shown) where rows and columns of data intersect to provide the correct aim or velocity information to the golfer. The putt distance may be represented as rows, the putt angle may be represented as columns (or vice-versa), and the expected break would be represented in the cells of the table where the row/columns intersect.

An additional embodiment of the invention would be an electrical display into which the user inputs the required parameters of green speed, putt length, and putt angle and the corresponding expected break amounts are displayed. For example, a portable computing device may receive inputs of green speed, putt length, and putt angle. With reference to the putting reference guide of the invention, the processor would output the expected break amount. In one embodiment, the electronic display may comprise a graphical display of the putting reference guide for the selected hole. The user input may comprise a touch screen wherein the user touches the appropriate ring representing the putting distance and touches the appropriate spoke/line representing the putting angle. The device thereafter processes the input with one or more processors and displays the expected break on the graphical display of the putting reference guide, such as by highlighting the intersection between the spoke and ring. Alternately, inputs may be received numerically though keypads or the like and outputs may be displayed numerically.

Another embodiment of the invention is to have a similar chart for different shapes of greens other than planar. For example, the expected break on a convex ("crown") shaped green or concave ("saddle") shaped green would be different than on a planar green. Use of the invention would be similar to that already described with the data being correlated to the particular shaped green.

A collection of charts may be provided in booklet form, sorted by hole, by green speed, or the like. The charts may be semi-circular charts as described herein or circular charts. The collection may also be stored in a computer readable medium (e.g., computer disk, CD, tape, click-drive, hard-drive, memory) for display with an electronic display device (such as a PDA, computer, and handheld device). The computer-readable medium may comprise a database of the collection of charts. Or, the computer-readable medium may comprise software for implementing the methods of the invention in addition to the data for the charts.

Obviously, numerous modifications and variations of the present invention are possible in light of the above teachings. It is therefore to be understood that within the scope of the appended claims, the invention may be practiced otherwise as specifically described herein.

The invention claimed is:

1. A method for improving golf play comprising, for each selected golf hole of a golf course played, the steps of:

(a) selecting a corresponding putting reference guide from a plurality of putting reference guides for a hole, each guide correlated to a golf hole of a golf course and including, for said golf hole;

(b) orienting the putting reference guide with a center point representing the hole and a reference point comprising a point of orientation for the putting reference guide along its circumference, said reference point located on a center line dividing the putting reference guide in half and intersecting the center point, wherein said center line allows for alignment of the putting reference guide with a straight downhill direction of a slope with said reference point orienting the putting reference guide towards a point of source of the slope;

(c) estimating the putt's angle of a desired golf stroke with respect to the reference point, and locating this angle on the guide, represented as a series of spokes radiating from the center point;

(d) estimating the distance of the desired golf stroke and locating this distance on the guide, represented as a series of circumferential rings around the center point, wherein each ring represents a distance out from the hole; and (e) ascertaining the intersection of the ring and spoke locations to find a pre-calculated approximation of an expected break amount representing the amount to the left or the right of the hole for aiming based on the intersection being located in the left or right half of the putting guide, respectively.

2. The method of claim 1 wherein the spokes are labeled in a series of 360 degree measurements from the reference point with 0 representing the reference point.

3. The method of claim 1 wherein the spokes are labeled as hour hand positions on a clock face from the reference point with 12:00 representing the reference point.

4. The method of claim 1 wherein for intermediate angles, an average expected break amounts is used.

5. The method of claim 1 wherein for intermediate distances, an average of the expected break amounts is used.

6. The method of claim 1 wherein the putting reference guide is displayed as two semi-circles along the center line each representing a different slope or a different green speed, wherein the ascertained expected break amounts for a selected slope or green speed on the semi-circle not represented is assumed to be a mirror of the selected slope or green speed on the semi-circle represented.

7. A computer implemented method for determining expected break amount, the method comprising:

(a) receiving a selection of a corresponding putting reference guide from a plurality of putting reference guides for the hole, each guide correlated to a golf hole of a golf course;

(b) orienting the putting reference guide with a center point representing the hole and a reference point comprising a point of orientation for the putting reference guide along its circumference, said reference point located on a center line dividing the putting reference guide in half and intersecting the center point, wherein said center line allows for alignment of the putting reference guide with a straight downhill direction of a slope with said reference point orienting the putting reference guide towards a point of source of the slope;

(c) receiving from a user an estimated putt's angle of a desired golf stroke with respect to the reference point, and correlating by one or more processors this angle on the guide;

(d) receiving from the user an estimated distance of the desired golf stroke and correlating by the one or more processors this distance on the guide, represented as a series of circumferential rings around the hole, wherein each ring represents a distance out from the hole;

(e) outputting to the user for the correlated ring and spoke location an expected break amount comprising a calculated approximation of a numerical amount of break a ball will experience.

8. The computer implemented method of claim 7 wherein the spokes are labeled in 360 degree measurements from the reference point with 0 representing the reference point.

9. The computer implemented method of claim 7 wherein the spokes are labeled as hour hand positions on a clock face from the reference point with 12:00 representing the reference point.

10. The computer implemented method of claim 7 wherein for intermediate angles, an average expected break amounts is calculated and output to the user.

11. The computer implemented method of claim 7 wherein for intermediate distances, an average of the expected break amounts is calculated and output to the user.

* * * * *